United States Patent [19]

Reinelt et al.

[11] Patent Number: 4,757,835

[45] Date of Patent: Jul. 19, 1988

[54] CHANGE-OVER VALVE FOR HYDRAULIC WALKING MINE-ROOF SUPPORTS

[75] Inventors: Werner Reinelt, Bochum; Wolfgang Kobow, Wuppertal; Karl Krieger, deceased, late of Wuppertal, all of Fed. Rep. of Germany, by Hildegard Krieger, legal representative

[73] Assignee: Hermann Hemscheidt Maschinenfabrik GmbH & Co., Wuppertal, Fed. Rep. of Germany

[21] Appl. No.: 931,588

[22] Filed: Nov. 14, 1986

[30] Foreign Application Priority Data

Nov. 15, 1985 [DE] Fed. Rep. of Germany ..... 3540531

[51] Int. Cl.[4] ..... F15B 13/04

[52] U.S. Cl. ..... 137/112; 91/33; 91/447

[58] Field of Search ..... 91/447, 33; 137/112

[56] References Cited

FOREIGN PATENT DOCUMENTS 1503364 4/1969 Fed. Rep. of Germany ..... 91/447
2639331 3/1978 Fed. Rep. of Germany ..... 91/447
3304982 9/1984 Fed. Rep. of Germany .

*Primary Examiner*—Gerald A. Michalsky
*Attorney, Agent, or Firm*—Berman Aisenberg & Platt

[57] ABSTRACT

A change-over valve for hydraulic walking mine-roof supports comprises a valve housing containing a sealed-off operating piston in which a valve member supported on a helical spring is displaceably arranged, the piston being responsive to the supply of small quantities of hydraulic fluid through an end connection in the housing and having a sealing cone adapted to close a connection of large throughflow cross-section at the opposite end of the housing which also has a side connection for the supply of pressurized fluid to a working cylinder of a mine-roof support, the large throughflow cross-section at the connection thereby guaranteeing brisk pushing-in of a piston rod of a piston in the cylinder.

3 Claims, 1 Drawing Sheet

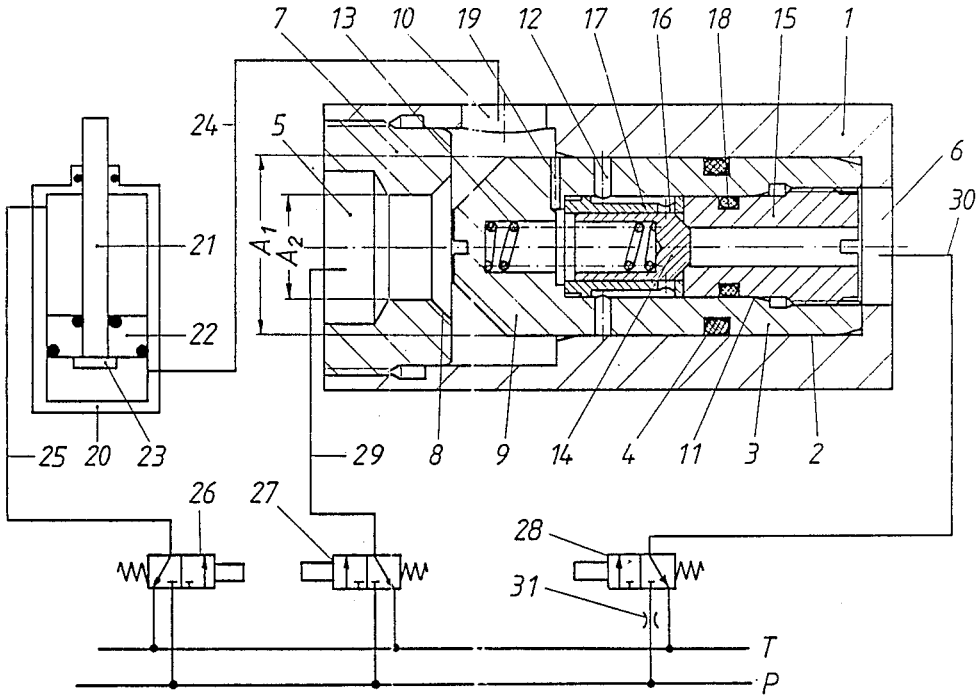
7
13
10
19
12
17
16
18
15
1
24
5
6
30
21
$A_1$
$A_2$
22
25
20
23
29
8
9
14
4
11
3
2
26
27
28
31
T
P

CHANGE-OVER VALVE FOR HYDRAULIC WALKING MINE-ROOF SUPPORTS

This invention relates to a change-over valve for hydraulic walking mine-roof supports.

Change-over valves can be used to supply pressurised fluid—which is received alternately from different inlet conduits—through one specific outlet. Such a valve is used for example in the control system of hydraulic walking mine-roof supports wherein one side of a piston in a woring cylinder is charged alternately with pressurised fluid by way of two different control valves. Known change-over valves (see, for example, DE-PS-3,304,983) according comprise a valve housing with two connections for the supplied pressurised fluid and one connection for the pressurised fluid outlet. Between the connections for the supplied pressurised fluid, or between two sealing seatings associated with these connections, the valve housing has a closure body which is pressed by the inflowing pressurised fluid in each case on to a sealing seating lying opposite to the inflow side. The closure body closes the pressureless connection and prevents the transfer of inflowing pressurised fluid to the second control valve which, in this operational position, is generally connected with the return conduit connected to a fluid reservoir. The actuation movement and the application pressure result from the fluid flow of the pressurised fluid supplied to the valve. If the inflow is only slight, then the closure body is no longer pressed on to the sealing seating and the supplied pressurised fluid flows in short circuit away to the pressureless connection. This condition can occur, for example, in the control of the hydraulic advancing cylinders of walking mine-roof supports which are connected to a conveyor. The advancing cylinders serve to press the conveyor forwards during winning of the mineral from the working face of the mine into the cleared space in front of that working face and also to draw up the walking mine-roof supports after the winning operation.

A particular problem arises however in the operation of the advancing cylinders of hydraulic walking mine-roof supports, especially during winning of mineral by "skimming" when the pressing-forward of the conveyor takes place slowly, that is to say, with a small supply of pressurised fluid. On the other hand, the "drawing-up" of the supports should take place quickly, which means that pressurised fluid previously introduced into the advancing cylinders during the pressing forwards of the conveyor should flow away again as far as possible without hindrance through a passage of large cross-section. In the pushing forwards of the conveyor, all the advancing cylinders of the walking mine-roof supports are simultaneously charged with pressurised fluid so that the quantity of hydraulic fluid supplied to each advancing cylinder per unit of time is comparatively small and does not suffice to actuate a connected change-over valve in a sealed manner. Conversely, the supplied pressurised fluid should flow away through a passage of the largest possible cross-section. The change-over valves used hitherto are not very suitable for this purpose, since the closure body does not assume a defined operational position during flowing back of the hydraulic fluid.

The aim of the present invention accordingly is to devise a change-over valve wherein the closure body assumes a stable and defined operational position even in the case of a small inflow of pressurised fluid and wherein a passage having a large throughflow cross-section is available for the outflowing pressurised fluid.

With this aim in view, the invention is directed to a change-over valve for hydraulic walking mine-roof supports, comprising a valve housing having three fluid-flow connections connectable to hydraulic control valves, hydraulic working cylinders or other parts of mine-roof supports, with one of the connections being arranged on a side of the housing and the other two connections at the ends of the housing, and a closure body which is axially displaceable in a central bore of the valve housing and which is chargeable with supplied pressurised medium during operation of the valve for the alternate connection of two connections while the third connection is closable as a result of the closure body being pressable on to a valve seating, in which:

(a) the closure body is formed as a generally cylindrical operation piston and is sealed off by means of a gasket or other seal in the housing bore;

(b) the piston forming the closure body has a sealing cone at one end;

(c) at the other end of the piston there is a longitudinal blind bore from which radial bores branch out; and (d) in the longitudinal bore of the piston a valve member is supported for axial displacement on a spring so that, under the pressure of the spring, it closes the opening in a hollow cylindrical bush which is sealingly inserted in the outer portion of the longitudinal bore of the piston.

A change-over valve in accordance with the invention therefore has an operating piston which is sealed off on its outer circumferential surface and which has an internal valve member supported on a spring on the fluid inflow side. In the case of a small supply of fluid, the piston shfts axially and closes a passage with a large throughflow cross-section on the opposing connection with a sealing seating. As the pressure of the pressurised fluid builds up before the valve member, it reaches a pressure head in excess of the pressure of the spring so that it opens the valve member and flows into the pressure chamber of the connected working cylinder. In the opposite direction the pressure fluid flowing out of the working cylinder presses the piston into the other open position which has a large throughflow cross-section.

An example of a change-over valve in accordance with the invention is shown by way of example in the accompanying drawing which shows the valve in longitudinal section.

The illustrated change-over valve is arranged to be charged with pressurised fluid on two sides for the charging of one piston side of an advancing cylinder in an hydraulic walking mine-roof support. The valve has a cylindrical housing 1 provided with a central graduated or stepped bore 2 in which a cylindrical operating piston 3 is displaceable guided for axial movement. On the outer circumferential surface of the piston 3 a gasket or other annular seal 4 is inserted into an annular groove (not designated) so as to seal off the gap between the piston 3 and the wall of the bore 2.

The bore 2 merges at the two ends of the valve housing 1 into two fluid connections 5 and 6, the connection 5 being machined into a valve insert 7 inserted into the bore 2 an having a frusto-conical sealing seating 8 for the piston 3. The sealing surface of the sealing seating 8, designated by $A_2$, is smaller than the cross-sectional surface $A_1$ sealed off by the gasket 4 on the piston 3. The piston 3 has a sealing cone 9 on its end which engages the sealing seating 8. On the side of the valve housing 1 there is a radial connection 10 which opens in the region of the sealing cone 9 into the central bore 2 of the change-over valve.

A longitudinal blind bore 11 having a shoulder or step between its ends is formed in the piston 3 so as to extend from that end adjacent the connection 6 and remote from the sealing cone 9. From this bore radial bores 12 branch outwards in star formation. The radial bores 12 are covered in one operating position of the piston 3 by the wall of the bore 2, but in another operating position of the piston they open into the connection 10. In the deepest part of the longitudinal bore 11 there is a helical compression spring 13 which acts on a valve member 14 so as to press it into sealing engagement with an inner end of a hollow cylindrical bush or sleeve 15 inserted into the longitudinal bore 11 from that end adjacent the connection 6. The valve member 14 is guided in a cage 17 having radial bores 16. On the outer circumferential surface of the bush 15 there is a gasket 18, while 19 designates a vent bore.

The change-over valve thus illustrated is intended to control an hydraulic working cylinder 20 of an hydraulic walking mine-roof support. The cylinder has a piston 22 which is displaceable on a piston rod 21 and which abuts at the end of the piston rod 21 on a collar ring 23. The working cylinder 20 is connected beneath the piston 22 and the piston rod 21 through the conduit 24 with the connection 10 of the change-over valve. The annular space of the working cylinder 20 above the piston 22 is connected by the conduit 25 to a directional control valve 26 having three ports and two distinct positions of operation so as to connect the valve 26 alternately to a high pressure conduit P and to a return conduit T leading to a fluid reservoir.

The connections 5 and 6 of the change-over valve are connectable alternately to directional control valves 27 and 28 each having three ports and two distinct positions of operation and each chargeable with high pressure fluid from the high pressure conduit P. The connection takes place through the conduit 29 from the directional control valves 27 to the connection 5 and through the conduit 30 from the directional control valve 28 to the connection 6. A constriction or throttle 31 provides a small throughflow quantity. The change-over valve is without pressure in the operational position illustrated since all the 3/2 directional control valves 26, 27 and 28 are opened through the return conduit to T.

Pressurised fluid flows through the 3/2 directional control valve 28, which is open to the high pressure conduit P, by way of the conduit 30 to the piston 3. Since the quantity of supplied fluid is only small, the sealed piston 3 is displaced towards the sealing seating 8 without the build-up of a pressure before the valve member 14. After the sealing cone of the piston 3 has come to abut on the sealing seating 8, the pressurised fluid builds up before the valve member 14, thereby causing the pressure to build up. When a pressure head sufficient to overcome the spring 13 is reached, the valve member 14 moves into an "open" position whereby the pressurised fluid flows by way of the bores 16 and 12 to the connection 10 and further, by way of the conduit 24, to beneath the piston 22 and the collar ring 23 of the piston rod 21, which is therefore moved outwardly.

On the other hand, the piston rod 21 can be charged with pressurised fluid from the 3/2 directional control valve 27 by way of the conduit 29 through the connection 6. The pressurised fluid arriving on the sealing cone 9 lifts the piston 3 away from the sealing seating 8 and displaces it towards the connection 6, whereby the throughflow cross-section to the connection 10 is cleared for the passage of fluid to the conduit 24.

The piston 21 of the working cylinder 20 is driven in again when the piston 22 is charged with pressurised fluid from the directional control valve 26 through the conduit 25. The pressurised fluid present in the pressure chamber beneath the piston 22 is then forced out through the conduit 24 to the connection 10. It presses upon the annular area $A_1$–$A_2$ on the piston 3, which results from the difference of the cross-sectional area $A_1$ of the piston and the sealing area $A_2$ on the sealing cone, and displaces the piston 3 in the direction towards the connection 6 so that the pressurised fluid flows away by way of the large throughflow cross-section at the connection 5 through the conduit 29 to be opened 3/2 directional control valve 27 towards T and into the return conduit.

We claim:

1. A change-over valve for hydraulic walking mine-roof supports, comprising a valve housing having three fluid-flow connections connectable to hydraulic components of mine-roof supports, with one of the said connections being arranged on a side of the housing and the other two connections at opposite ends of the housing, and a closure body which is axially displaceable in a central bore of the valve housing and which is chargeable with supplied pressurised medium during operation of the valve for the alternate connection of two connections while the third connection is closable as a result of the closure body being pressable on to a valve seating, wherein :

(a) a closure body is formed as a generally cylindrical operation piston and is sealed off by means of sealing means in the housing bore;

(b) the piston forming the closure body has a sealing cone at one end;

(c) at the other end of the piston there is a longitudinal blind bore from which radial bores branch out; and (d) in the longitudinal bore of the piston a valve member is supported for axial displacement on a spring so that, under the pressure of the spring, the valve member closes an opening in a hollow cylindrical bush which is sealingly inserted in the outer portion of the longitudinal bore of the piston.

2. A change-over valve according to claim 1, in which a sealing seating on which the sealing cone of the piston is arranged to seat has a smaller sealing cross-section than the cross-section of the piston sealed off by the sealing means.

3. A change-over valve according to claim 1 or claim 2, in which the valve body member is guided in a cage open to the radial bores so that, in the operational position which the piston assumes when the valve member is closed, the radial bores are closed by the housing and, in the operational position with the valve member opened, they are opened to the connection on the side of the housing.

* * * * *